US007861730B2

(12) United States Patent
Jordan

(10) Patent No.: US 7,861,730 B2
(45) Date of Patent: Jan. 4, 2011

(54) METHODS AND DEVICES FOR APPLYING SOLID NAIL COATINGS TO MAMMALIAN AND ARTIFICIAL NAILS

(76) Inventor: Janice Jordan, 3240 Westmont Dr., Fallbrook, CA (US) 92028

( * ) Notice: Subject to any disclaimer, the term of this patent is extended or adjusted under 35 U.S.C. 154(b) by 755 days.

(21) Appl. No.: 11/904,655

(22) Filed: Sep. 28, 2007

(65) Prior Publication Data

US 2008/0087291 A1 Apr. 17, 2008

Related U.S. Application Data

(60) Provisional application No. 60/848,126, filed on Sep. 29, 2006.

(51) Int. Cl.
*A45D 24/00* (2006.01)

(52) U.S. Cl. ..... 132/200

(58) Field of Classification Search ..... 132/73, 132/285, 200, 320, 319; 428/41.8
See application file for complete search history.

(56) References Cited

U.S. PATENT DOCUMENTS

| | | | | |
|---|---|---|---|---|
| 4,824,702 | A | 4/1989 | Straub | |
| 4,974,610 | A * | 12/1990 | Orsini | 132/73 |
| 5,209,250 | A | 5/1993 | Taeckens | |
| 5,309,365 | A | 5/1994 | Sullivan et al. | |
| 5,415,903 | A | 5/1995 | Hoffman et al. | |
| 5,525,389 | A | 6/1996 | Hoffman et al. | |
| 5,681,631 | A | 10/1997 | Steelman et al. | |
| 5,873,375 | A | 2/1999 | Johnson et al. | |
| 5,921,250 | A * | 7/1999 | Rhea et al. | 132/74.5 |
| 6,063,494 | A | 5/2000 | Schumann et al. | |
| 6,065,969 | A | 5/2000 | Rifkin et al. | |
| 6,328,949 | B1 | 12/2001 | Tessarolo et al. | |
| 6,491,781 | B1 | 12/2002 | Kreckel et al. | |
| 6,516,813 | B2 * | 2/2003 | Yiu | 132/73 |
| 6,561,196 | B2 * | 5/2003 | Gamburg | 132/73 |
| 7,123,983 | B2 | 10/2006 | Yogo et al. | |
| 2005/0061342 | A1 * | 3/2005 | Chapman | 132/73 |
| 2005/0150508 | A1 | 7/2005 | Downs et al. | |
| 2009/0126316 | A1 * | 5/2009 | Ilekti et al. | 53/111 R |

FOREIGN PATENT DOCUMENTS

| | | |
|---|---|---|
| WO | WO 2005/070048 | 4/2005 |

* cited by examiner

*Primary Examiner*—Robyn Doan
*Assistant Examiner*—Brianne O'Neill
(74) *Attorney, Agent, or Firm*—Merchant & Gould

(57) ABSTRACT

Devices, methods, and kits for making and using a graphic film laminate to decorate fingernail and/or toenail are provided. In one aspect, a thermally-curable vinyl-based pressure-sensitive self-adhesive nail cover/coating laminate is provided.

7 Claims, 7 Drawing Sheets

METHODS AND DEVICES FOR APPLYING SOLID NAIL COATINGS TO MAMMALIAN AND ARTIFICIAL NAILS

RELATED APPLICATIONS

This application claims priority to U.S. provisional application Ser. No. 60/848,126, filed on Sep. 29, 2006. The contents of which is hereby incorporated by reference in its entirety.

FIELD OF THE INVENTION

Aspects of the present invention generally relate to cosmetics. In particular, aspects and embodiments of the invention relate to methods and devices directed to a non-liquid graphic nail coating and/or covering for nail decorations.

BACKGROUND

The following includes information that may be useful in understanding the present invention. It is not an admission that any of the information provided herein is prior art, or relevant, to the presently described or claimed inventions, or that any publication or document that is specifically or implicitly referenced is prior art.

The field of cosmetics is flourishing. However, the application of fingernail polish onto fingernails and toenails is a long and laborious process. Typically, consumers desirous of decorating their fingernails and/or toenails with a particular color, artwork, and/or design usually need go to a professional nail salon and have the desired graphics applied manually in the form of a liquid nail-polish. These conventional liquid nail-polish manicures techniques often involve the laborious processes of filing, polishing, and painting (which may also include the application of primers, sealants, and/or topcoats) of the fingernail or toenails. In addition, conventional manicure techniques may also include the application of silk wrap, artificial nail tips (e.g. French manicure), acrylics, or artificial nail gels. These processes are usually costly, time-consuming (e.g. long drying time), and the finished nail surfaces are usually prone to chipping, thus, repeated applications are often necessary in order to maintain the desired appearance. Furthermore, many ingredients found in conventional fingernail polish and/or nail polish removers tend to contain harmful chemical components, including phthalates, formaldehyde, and/or organic solvents, many of which may produce noxious vapors that may be hazardous to one's health.

Various devices, methods, and systems have been devised to improve the nail art process, including for example, those reported in U.S. Pat. No. 5,309,365 U.S. Pat. No. 5,209,250, U.S. Pat. No. 4,824,702, U.S. Pat. No. 5,525,389, U.S. Pat. No. 6,491,781, U.S. Pat. No. 5,681,631, U.S. Pat. No. 7,123,983; U.S. Pat. No. 6,561,196; U.S. Pat. No. 6,328,949; U.S. Pat. No. 6,065,969; U.S. Pat. No. 5,873,375; U.S. Pat. No. 4,974,610; WO2005070048; U.S. Pat. No. 6,063,494; and US2005/0150508. However, certain conventional graphic sign-making techniques known in the art employ vinyl films impregnated with pigments or dyes, and these are used with release coated materials where transfer tapes are required for the sign making process. These conventional pigments suffer from the defect that they are not suitable for outdoor use because the dyes and pigments are subject to attack and degradation by ultra violet light. As a result, a certain number of these conventional techniques still require the use of chemical primers, sealants and top coats (often at room temperature) to supplement the application of these sign-making films for decorative purposes in order to produce a sustained and stable color and appearance characteristics. Thus, despite these attempts, the technique of applying liquid nail-polish remains as the primary and predominant approach for decorating fingernails and/or toenails in the cosmetic industry.

SUMMARY

Accordingly, to address some of these unmet needs, aspects and embodiments of the present invention provide convenient, durable, and environmentally friendly devices, methods, kits, and/or systems for decorating fingernails and/or toenails.

In one aspect, a nail coating/cover laminate configured to adhere to the nail top surface thereby covering substantially the entire nail top surface is provided. In one embodiment, the nail coating laminate is a vinyl nail laminate for decorating fingernails and/or toenails. In other embodiments, the vinyl film is a cast vinyl film. In certain other embodiments, the laminated vinyl film is a thermal-sensitive heat-curable laminated cast vinyl film. In yet another embodiment, the vinyl film is a heat-curable pressure sensitive adhesive film. In a further embodiment, the vinyl film is a digitally printed graphic film. In certain other embodiments, the vinyl film is a thermal transfer printed graphic film. In yet another embodiment, the vinyl film is a laminated, heat curable, thermal transfer printed graphic film.

In one aspect, a method of decorating a nail comprising: applying a thermal-sensitive vinyl film laminate to decorate a fingernail or a toenail is provided. In certain embodiments, the method further comprising applying an effective amount of heat to said thermal sensitive vinyl nail laminate to promote bonding between the nail laminate to said nail surface. In other embodiments, the method further comprising applying an effective amount of heat to said thermal sensitive vinyl nail laminate disposed over said nail surface to promote smoothness of the nail contour or to reduce surface wrinkle. In yet another embodiment, the vinyl film laminate comprises a user selected nail graphics suitable for decorating a nail. In certain other embodiments, the vinyl film laminate is transparent. In yet another embodiment, the vinyl film laminate is a cast film laminate. In yet another embodiment, the laminate is a pressure-sensitive self-adhesive laminate.

In one aspect, a method of removing nail decoration comprising: removing a thermal-sensitive cast vinyl film laminate from a fingernail or a toe nail, is provided.

In another aspect, a method of manufacture for a vinyl film laminate for nail decoration comprising: laminating a thermal-sensitive clear cast vinyl film top layer onto a graphics cast film vinyl film substrate useful for fingernail or toenails decoration. In certain embodiments, the method further comprising: providing a nail graphics selected by the user to be applied to the desired nail; printing the nail graphics onto a nail coating film substrate; heat-curing the nail graphics onto the film substrate; laminating a clear top layer vinyl film onto the heat-cured graphics film substrate; cutting the graphics laminate into predetermined sizes, shapes or sheets for application onto the nail; removing the excess material after cutting; and packaging the nail cover laminates.

In one aspect, a method of applying a thermal-sensitive vinyl nail coating laminate for fingernail or toenail decoration comprising: providing a thermal-sensitive vinyl nail cover laminate comprising a nail graphics selected by the user to be applied to a nail surface and the laminate being attached to a backing material; cleaning the nail surface to which the nail cover laminate is to be applied, the nail surface having a curved contour; pre-heating the nail cover laminate; removing the heated nail cover laminate from the backing material; applying the nail cover laminate onto the nail surface; heat-curing the nail cover laminate disposed over the nail surface by applying heat; conforming the nail cover laminate according to the contour of the nail surface; shaping the nail cover laminate; applying a second heating to cure the nail cover laminate disposed over the nail surface; and conforming the nail cover laminate according to the nail surface contour, is provided In another aspect, a method of removing a thermal-sensitive vinyl nail coating laminate for fingernail or toenail decoration comprising: providing a nail cover laminate disposed over a nail surface; heating the nail cover laminate to release the laminate from the nail surface; peeling peripheral portion of the nail cover laminate to be removed; grasping the peeled peripheral portion of the nail cover laminate; and removing the nail cover laminate from the nail surface, is provided.

In yet another aspect, a thermal sensitive laminated nail coating comprising: a clear vinyl film top layer; a middle vinyl film layer with a self-adhesive bottom face and a nail graphics top face with digitally printed graphics disposed between the top layer and the second layer; and a bottom backing layer with self-adhesive disposed thereon is provided.

In yet another embodiment, a nail coating laminate comprising: a thermal-sensitive clear cast vinyl film top layer laminated onto a thermal-sensitive cast vinyl film middle layer wherein said cast vinyl film middle layer comprises a self-adhesive bottom face; and a bottom backing layer with self-adhesive disposed thereon configured to releasably and peelably adhere to the cast vinyl film middle layer is provided.

In yet another aspect, a kit for decorating nails comprising: a package of ready to apply thermal curable pressure sensitive self-adhesive cast vinyl laminate is provided.

The inventions described and claimed herein have many attributes and embodiments including, but not limited to, those set forth or described or referenced in this Brief Summary. It is intended to be all-inclusive and the inventions described and claimed herein are not limited to or by the features or embodiments identified in this Brief Summary, which is included for purposes of illustration only and not restriction.

Various aspects of the present invention will be readily understood by the following detailed description in conjunction with the accompanying drawings, wherein like reference numerals designate like elements in the several views. It is understood that the embodiments of the invention may have more or less components than are shown in the figures.

DETAILED DESCRIPTIONS

Figure 1:
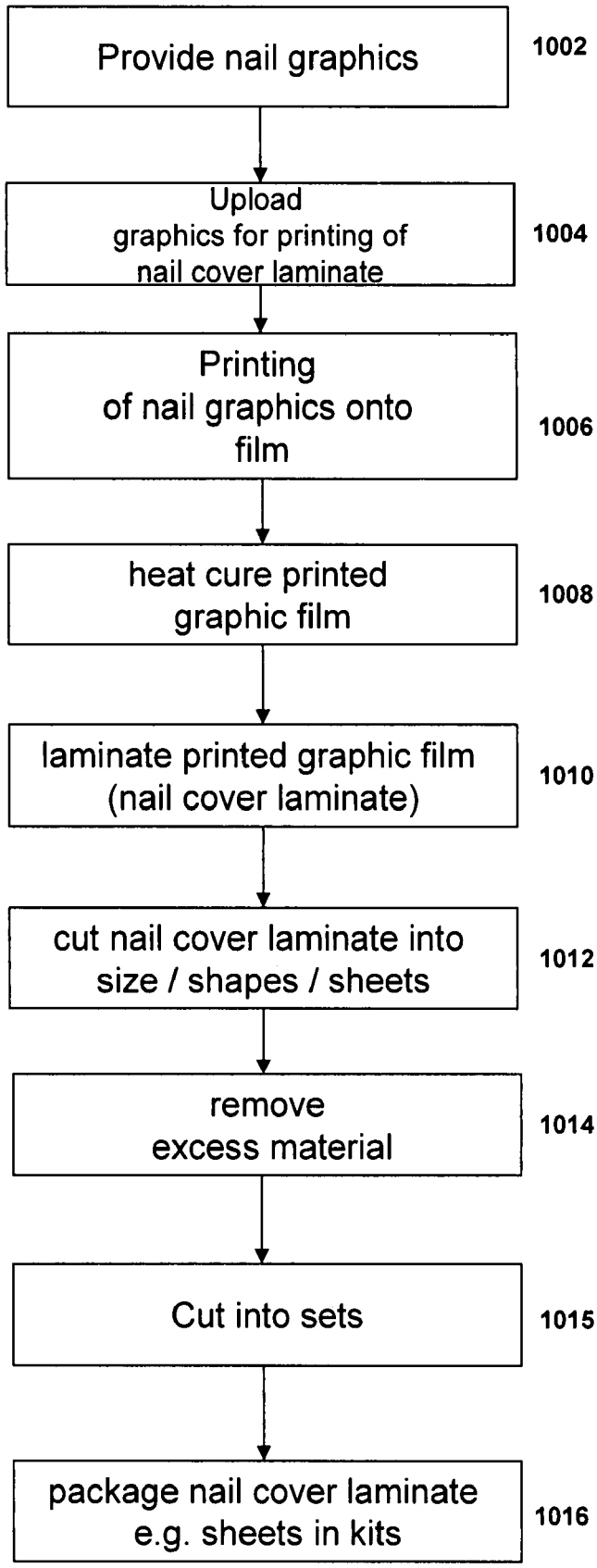
FIG. 1 illustrates an exemplary manufacturing method embodiment for the manufacture of nail cover laminate embodiment according to the present invention.

The present invention now will be described more fully hereinafter with reference to the accompanying drawings, in which illustrative embodiments of the invention are shown. However, this invention may be embodied in many different forms and should not be construed as limited to the embodiments set forth herein. Rather, these embodiments are provided so that this disclosure will be thorough and complete, and will fully convey the scope of the invention to those skilled in the art.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises," "comprising," "includes" and/or "including" when used in this specification, specify the presence of stated features, steps, operations, elements, and/or components, but do not preclude the presence or addition of one or more other features, steps, operations, elements, components, and/or groups thereof.

Accordingly, there is a need for improved methods, kits, devices and systems for decorating fingernails or toenails other than the conventional liquid nail polish-based approach.

Accordingly, there is a need for methods, kits, devices and systems for decorating fingernails or toenails by applying non-liquid nail coating onto same.

Accordingly, there is a need for methods, kits, devices and systems for removing nail coatings without the use of a nail polish remover.

Additionally, there is a need for flexible nail coating/cover and methods of applying thereof with improved dimensional stability, conformability, durability, and a "paint-like" finish.

Furthermore, there is a need for methods of manufacture for laminated graphics-embedded flexible nail covering for decorating fingernails and/or toenails.

Aspects of the present invention relate generally to improved methods, kits, devices and systems for decorating fingernails or toenails.

Aspects and embodiments of the present invention are based on an unexpected discovery that certain vinyl films, such as, for example, vinyl casting films commonly used in the graphic arts, when thermally activated and/or thermally cured during the application process, can yield the unexpected benefit of improved flexibility, conformity, appearance, and adherence to the nail surface when used as a coating for fingernails or toenails. In addition, when laminated with a clear coating film, these laminates nail covers have the added benefit of improved durability as nail coatings/covers. Furthermore, these additional benefits are realized without the use of chemical primers, clear-coats, or topcoats.

In one aspect, an apparatus, method, and computer-readable medium configured to generate an image onto a graphic film for application onto a fingernail or toenail is provided. Other embodiments of the present invention may include a scanning or color adaptation scheme for matching colors and printing onto a graphic film for application onto a fingernail or toenail.

In certain embodiments, the invention provides a thermal- and/or pressure-sensitive adhesive-backed film which adds strength and beauty to mammalian and artificial nails. The application of an opaque or clear graphic film onto fingernails or toenails provides the elements of nail polish but includes the added benefits of nail support, graphics, specialty colors, no liquid, no dry time, no brush-no mess, no uneven brush strokes, no chipping, no known cancer causing chemicals, no fumes, and easy removal. The nail coating is water-, detergent-, and abrasion-resistant. Embodiments may include any graphic film known in the art. In one embodiment, for example, may include the 3M™ Scotchcal™ Graphic films, manufactured by the 3M Corporation. It is understood that other films, such as, for example, graphic films, self-adhesive films, vinyl, polyester, Mylar, latex, rubber, or other films may be used for this purpose.

As used herein, exemplary nail cover/coating may include, for example, any non-liquid thermally curable pressure sensitive self-adhesive film. Exemplary material may include thermal sensitive graphic films. Graphic film suitable for methods embodiments of the present invention may include, for example, any self adhesive thin film type material vinyl film, cast film (film manufactured by cast method), "2 mil" film, "high performance" film, "long-term" film, or "premium" films. As used herein, "thin film" may include vinyl casting graphic film about 2 millimeters or less. In certain embodiments, the graphic laminate includes a graphic film of about 2 millimeter or less laminated to a clear coat vinyl casting film layer of about 2 millimeter or less. In certain embodiments, film and/or substrates may include various embedded visual effects such as, for example, varying degrees of shading and/or transparencies, varying background patterns, varying optical properties such as, for example, refractivity, fluorescence, pearlescence, night-glow, clear, matte, glossy, holographic, iridescent, glitter, and/or other decorative visual effects.

As used herein, "vinyl film" may include any solid or flexible film manufactured by casting methods known in the art. Exemplary vinyl casting films are well known in the graphic arts. In contrast, vinyl calendered films such as those manufactured by "calender" methods, are commonly used in the sign-making arts. In one embodiment, for example, flexible casting film may include the 3M™ Scotchcal™ Graphic films, manufactured by the 3M Corporation. It is understood that other graphic films, vinyl, Mylar or other films may be used for this purpose.

In certain other embodiments, exemplary vinyl films may comprise polyvinylchloride (PVC) polymer, polymeric or monomeric plasticizer (to modulate flexibility), pigment (to make desired coloration), UV absorbers (to improve resistance to UV radiation), heat stabilizers, fillers and processing aids. In certain embodiments, cast films may offer the added benefit of dimensional stability, thinness (about 2 millimeters or less), conformability, durability, and a "paint-like" finish.

As used herein, "shaping" includes using a plotter to cut nail covering material using the digitized nail image such that the nail covering material conforms to the nail top surface thereby producing a nail cover sized to cover substantially the entire nail top surface.

As used herein, "filing" includes all known methods of reducing the excessive material down to the desired nail outline by methods known in the cosmetic arts. Exemplary filing technique may include, for example, methods involving the use of a crystal nail file and/or a scissors and/or a nail clipper.

As used herein, nail surface may include both natural nail surfaces or extensions thereof by any known methods or techniques known in the cosmetic arts. Nail graphics or protective clear laminate may be applied to natural nail surfaces as well as surfaces generated by artificial nails, including artificial nail surfaces generated by "nail sculpting"

As used herein, "nail sculpting" process may include attachment of pre-made artificial fingernail tip to the tip of a real finger by an adhesive or a supporting sheet. The supporting sheet may be attached just under the tip of a real finger, then a thermoset material (e.g. acrylic type) is then applied onto the natural fingernail from the cuticle of the natural finger and sculpted to cover the whole artificial fingernail tip or a portion of the supporting sheet, such that a uniform extended surface is created. Once the thermoset material dries naturally or under ultraviolet lighting, abrasive filing is applied to create a desired shape for each fingernail.

As used herein, "nail wrapping" may include the process by which fabric pieces are cut off and glued onto a natural fingernail. After a few layers of fabric are glued and dried, coats of filler material are applied to create a continuous uniform surface. After abrasive filing to the desired nail shape, the nail can then be decorated.

As used herein, exemplary nail graphic suitable for placement on the nail cover may include, for example, any user desired image, design, pattern, photograph, or color scheme. In certain embodiments, nail cover laminate may include printed nail graphics with designs and/or colors commonly associated with the application of "French Tip" and/or any decorative and/or metallic features. Certain embodiments may also include the application of small decals, metallic flakes, or imitation jewels.

In certain embodiments, a printer may be used to print Pantone-matched colors or any number of logos, designs, or images onto a fingernail-sized graphic film. It is understood that any printer capable of spot color printing onto a graphic film may be used.

As used herein, suitable printing method may include, for example, digital printing, thermal direct printing, thermal transfer printing, thermal process printing, ink-jet printing, screen printing, electrostatic printing, piezo ink jet printing, and/or thermo inkjet printing.

In certain embodiments, the manufacture of the graphic nail coating laminate may comprise printing by a thermal transfer printing process. Exemplary thermal transfer printing process may include the use of a normal label media (e.g. film, paper) and a ribbon. The print head is heated and applied to the ribbon, the heat is transferred to the ribbon which contains ink. The heated ink is then transferred to the film substrate.

In certain embodiments, the manufacture of the graphic nail coating laminate may comprise printing by the thermal direct printing process. In a typical thermal direct printing process, the labels themselves are heat sensitive and the color transfer does not require a ribbon.

As used herein, exemplary thermal ribbons suitable for the printing processes described herein may include wax, wax-resin or pure resin. Exemplary pure resin ribbons are formulated to print onto plastic labels such as polyester, polypropylene and vinyl. The "ink" is designed to slightly dissolve into or adhere to the plastic surface of the label and becomes more durable, depending on the plastic material and ribbon make used. Certain printer/ribbon/film substrate combinations such as those described herein tend work well together, which is particularly important as some combinations produce no image at all.

In certain embodiments, printers suitable for the manufacturing of nail graphics laminate embodiments of the invention may include digital or electronic printer, such as, for example, thermal resin printer, which applies melted resins to a portion of the top surface of the self-adhesive film. Exemplary suitable thermal-resin printer includes Roland™ PC-12 Thermal Resin Printer/Cutter. In certain other embodiments, suitable printers may include inkjet printer, which applies ink to the top portion of the film. The ink may penetrate the top portion of the film substrate as well as adhering to the surface. Exemplary ink-jet printer may include the Versa CAMM™ Inkjet Printer/Cutter (Roland DGA Corporation, Irvine, Calif., USA). In certain other embodiments, suitable printer may include any other types of computer-controlled printers, such as, for example, dye sublimation and laser printers as well as any other integrated wide-format printer (e.g. Roland SOLJET™ printing and contour cutter), cutting plotter or cutting printers systems.

As used herein, cutters suitable in the manufacturing of the nail graphics laminate embodiments of the present invention may include, for example, a computer-controlled electronic cutter. In certain embodiments, the electronic cutter is integral with the electronic printer. Exemplary precision computer-controlled cutters, may include, for example, such as those manufactured by Gerber, Mimaki, Allen, and Graphtec.

In certain embodiments, on long nails the nail coating may be applied to the backside of the nail for added strength. A white coating film may be used to give the nail a "French manicure" look. In certain embodiments, the colors and/or graphics associated with the "French manicure" look is printed directly on the film substrate which does not require application of additional "French tips."

The nail coating is applied manually to the nail surface. The nail coating/cover can either be cut out with a manual cutting device such as a scissors or cut with an automated cutter.

As used herein, thermal-cure or thermal-activate may include the process of applying efficacious amount of heat to the site of the thermally sensitive nail coating/cover material in situ (disposed over the desired nail surface) wherein the heat applied is sufficient to favorably alter the physical properties of the film to improve placement, appearance, conformity, during the application process. In certain embodiments, application of heat renders the self-adhesive film more pliable and elastic, thus permitting a better fit to the nail surface. In certain embodiments, thermal sensitive film may include suitable vinyl film in which the laminating process is facilitated by the application of heat.

As used herein, manufacturing methods embodiment of the present invention may include the process of lamination well known in the art. Exemplary laminating process includes thermal lamination process wherein the lamination is based on the application of heat. Suitable laminating films typically contain heat sensitive coating one side and the material is passed through heated roll or laminator. In certain embodiments, suitable pressure is applied in combination with the heat application until the lamination process is completed. In certain embodiments, graphics nail coating/cover are laminated by bonding to a clear film top layer and a self-adhesive/backing bottom layer. A skilled artisan would appreciated that various laminating material such as, for example, standard thermal laminating films, low-temperature thermal laminating films, heatset (or heat-assisted) laminating films, pressure-sensitive films, liquid laminates; adhesives; equipment (e.g. pouch laminators, heated roll laminators, cold roll laminators); and processes may be used. In certain embodiments, laminating process may be adjusted to alter the glossy or matte appearance of the substrate.

As used herein, clear nail cover laminate (laminate without graphics) embodiments of the present invention may also be applied as a protective top layer in combination with graphics applied by conventional nail decoration techniques, including, for example, "acrylics" which typically comprises a mixture of a polymer powder and a liquid monomer (e.g. ethylmethacrylate) and "UV gel", which typically comprises a polymer resin which hardens under ultraviolet light.

Other embodiments may include an apparatus or printing device or a scanning or color adaptation scheme for matching colors and printing onto a graphic film for application onto a fingernail or toenail.

FIG. 1 illustrates a block diagram of an exemplary method of manufacturing the exemplary heat curable pressure sensitive nail cover laminates. A nail graphics is selected 1002 and uploaded 1004 for printing to a suitable printing system. Printing systems and/or machines compatible with cutting and forming or stock film such as vinyl films are well known in the art and commercially available for this purpose. Exemplary printing/cutting machines include computer-aided sign making machines such as those manufactured by Gerber Scientific Instruments, such as the SIGNMAKER™ IVB and the GRAPHIX 4B and 4E, GSP SPRINT IIB, SUPERSPRINT Model B machines, as well as those manufactured by Gerber, Mimaki, Allen, and Graphtec.

Figure 4:
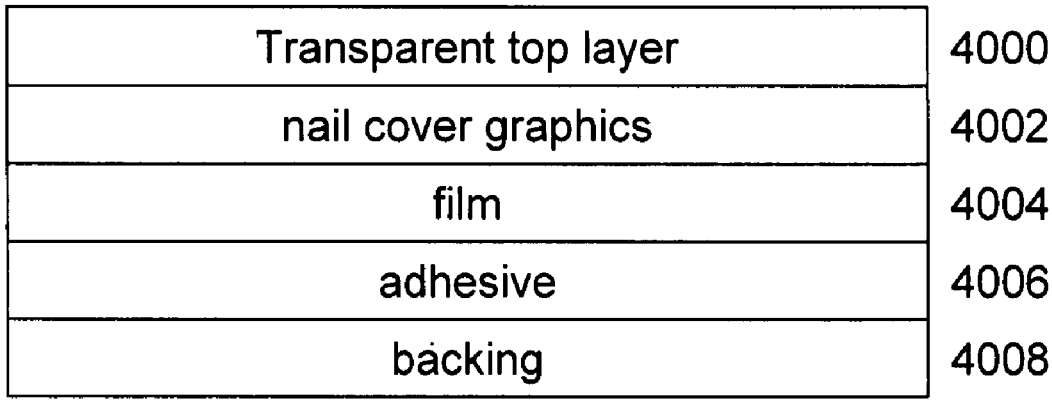
FIG. 4 illustrates a cross-sectional view of an exemplary nail cover laminate embodiment.

Suitable film stock material (e.g. thermal transfer imaging film material) in accordance with the embodiments of the invention is initially fed through such printing/cutting machine to generate suitable templates for graphics printing 1006. In certain embodiments, stock film material may be pre-formed with perforations to facilitate separation. Exemplary printing methods may include thermal transfer printing. The generated printed templates are laminated 1010 under the action of heat and/or pressure 1008 and adhered to their corresponding counterpart surfaces as shown in FIG. 4.

General nail templates sized according to the respective nail profiles of the various demographics cohorts (e.g. templates for women's finger and toe nails; small and large sizes for men and children; other mammal e.g. horses) are selected to be used as printing substrates 4004. The nail graphics 4002 are designed to fit within the respective nail template profiles. Nail graphics 4002 are printed onto the top portion of the self-adhesive (4006) film substrate 4004, which has a peelable/releasable backing 4008. A clear (without graphic) top layer 4000 is laminated onto the nail graphics which is transferred onto the film substrate. Top layer may be composed of the same material as the film substrate layer (e.g. vinyl casting film). In certain embodiments, the cutting 1012 (with or without computer-aided) may be based on the perimeter and/or outline of the individual finger or toe such that the graphics containing self-adhesive nail laminates can be remove or peeled from the backing. Excess material is removed either manually or by computer-aided processes 1014.

In certain embodiments, the cutting 1012 (with or without computer aided) generates individual sheets of graphic (or clear) nail cover laminates for packaging 1016. The sheets may contain multiple units of the same graphics design or combinations of various designs and/or sizes.

Figure 2:
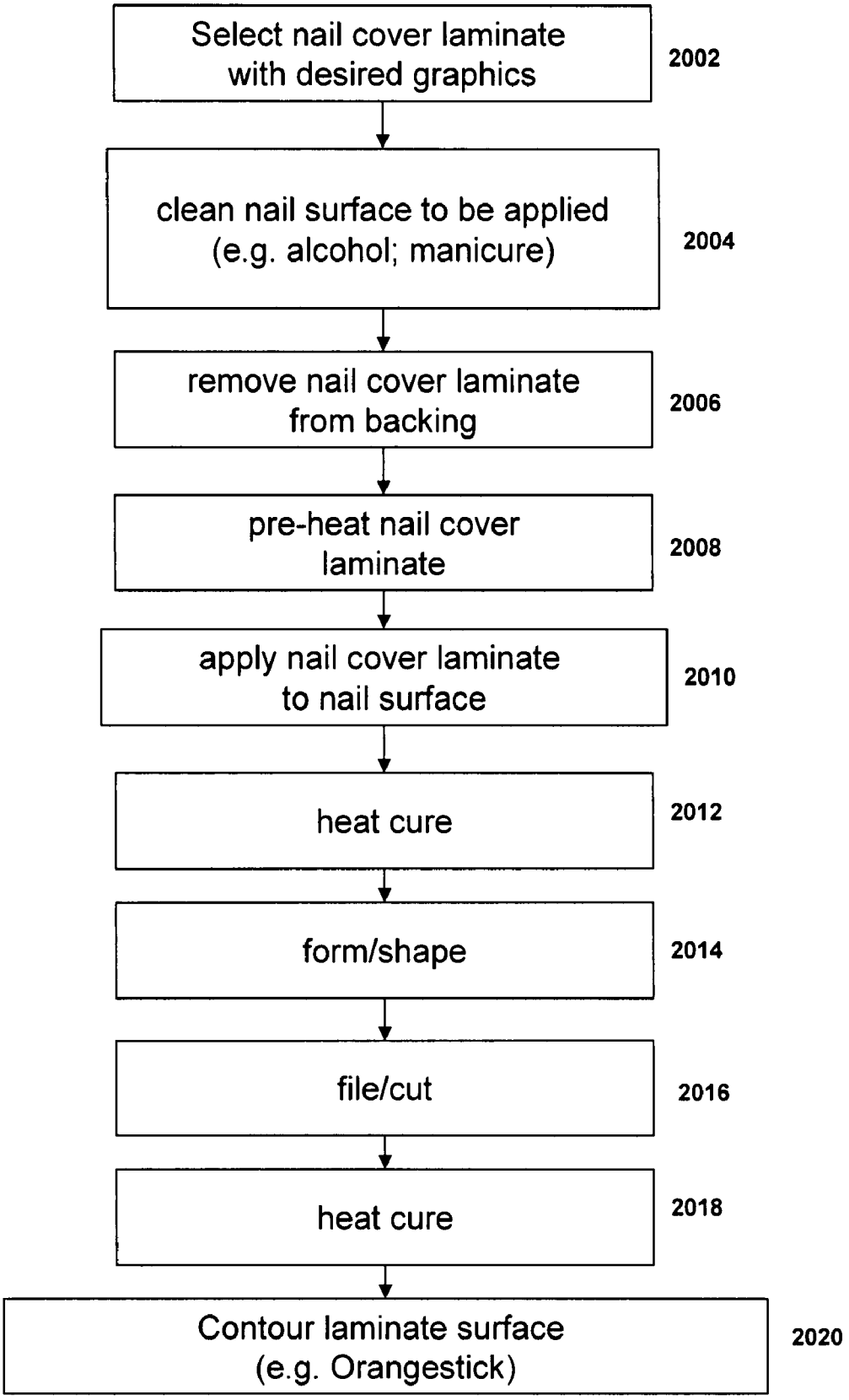
FIG. 2 illustrates an exemplary method embodiment for applying a nail cover laminate embodiment according to the present invention. Exemplary nail cover laminate illustrated herein may include method of applying graphic film to nails.

FIG. 2 illustrates a block diagram of an exemplary method of applying the exemplary heat curable pressure sensitive nail cover laminates. To apply a pre-printed graphics nail cover laminate 2002, the surface of the nail to which the graphics laminate is to be applied is pre-cleaned (e.g. alcohol or following a manicure). The laminate is peeled off 2008 of the corresponding backing 4008, then placed 2010 onto a corresponding nail (e.g. similar width) surface. In certain embodiments, the laminate may be pre-heated to facilitate the ease of manipulation 2006. The nail graphics laminates are located where desired on the nail surface, adequate heat and/or pressure is applied to the assembly to adhere the nail graphics laminate onto the nail surface. The backing sheet may then simply be peeled away to leave the graphics on the surface of the nail in the desired position. The laminate is then formed and shaped and/or smoothed onto the nail surface 2014, the excess material (e.g. length) is trimmed off by cutting or filing 2016. In certain embodiments, heat may be applied to cure the bonding between surfaces 2018 or may be applied to increase the flexibility of the laminate to facilitate manipulation 2012. In certain embodiments, the contouring of the nail surface may be performed with the aid of an Orangestick.

Figure 3:
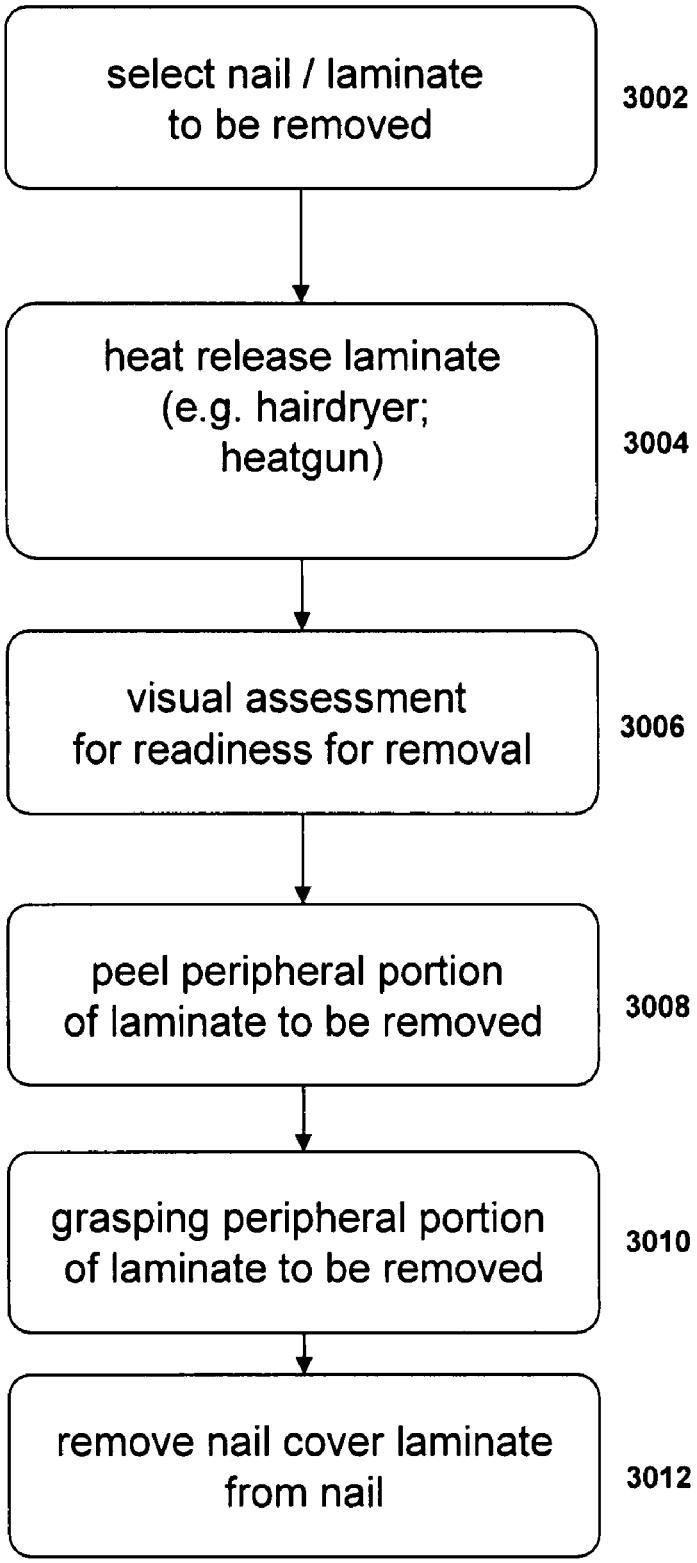
FIG. 3 illustrates an exemplary method embodiment for removing a nail cover laminate embodiment according to the present invention.

FIG. 3 illustrates a block diagram of an exemplary method of removing the exemplary heat curable pressure sensitive nail cover laminates. To remove the laminate from the nail surface 3002, the laminate is "heat released" 3004 from the surface by applying a steady heat source (e.g. heat gun, blow dryer) to the surface such that the nail cover laminate becomes increasingly pliable and flexible. In certain embodiments, a visual assessment may be performed to determine the readiness of the laminate for removal 3006. A small peripheral portion of the laminate is peeled off with or without an instrument 3008, then the remaining portion may be removed 3012 by grasping 3010 the peeled off portion with or without the aid of an instrument. In certain embodiments, the peeling motion is from side-to side (vs. tip to base).

FIG. 4 illustrates a partial cross-sectional view through an exemplary nail cover laminate embodiment. The laminates may be manufactured from heat curable pressure sensitive self-adhesive vinyl casting film. The laminate embodiment has several layers as shown. The top layer is preferably a clear vinyl top coat layer 4000 laminated onto the graphics film substrate containing the printed nail graphics. The top layer is preferably configured without graphics patterns or color to allow visualization of the graphics layer underneath.

The next layer is preferably the printed graphics layer 4002. The printed graphics layer consists essentially of the dye- and/or pigment-containing layer capable of adhering, under the action of heat and/or pressure, to a thin film substrate, such as, for example, a vinyl casting film substrate 4004. The graphics layer is the primary layer which imparts visibility to the graphics laminate. It includes generally a pigment and/or dye material in which the graphic design is formed during the printing process, such as, for example, thermo transfer onto vinyl films. In certain embodiments, the dye or pigment-containing layer may be made up of a plurality of successive dye- or pigment-containing layers. The next layer contains the self-adhesive 4006, which is releasably peelable from the bottom backing layer 4008. Before laminates are applied by the user, for example, during storage, manufacturing, or transport, the backing 4008 is preferably adhered to the self-adhesive layer 4006. When ready, the graphics nail laminates are removed from the backing 4008 for application. Suitable backing material are well known in the art and are commercially available, exemplary material may include any flexible backing material that are dimensionally stable to facilitate handling. In certain embodiments, the backing material is in the form of a strip or a roll of paper or film stock having suitable perforations. In certain other embodiments, dimensionally stable plastics films, such as, for example, polyethylene terephthalate films, may be used.

Figure 5:
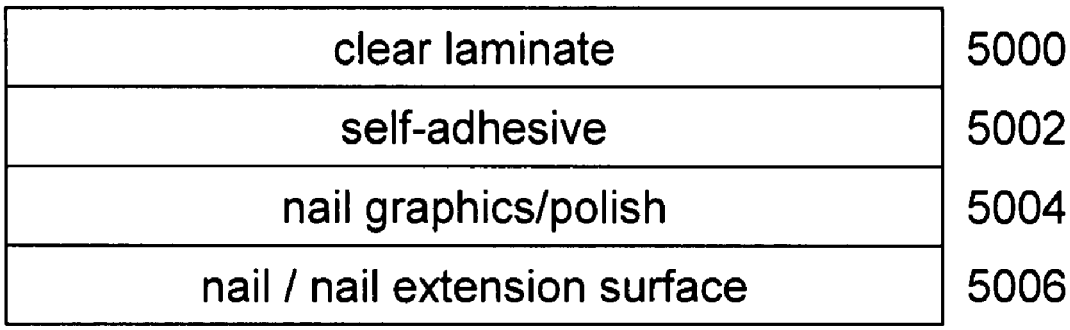
FIG. 5 illustrates a cross-sectional view of an exemplary clear nail cover laminate embodiment configured to protect, and disposed over, existing conventional manicured nail surface.

FIG. 5 illustrates the use of an exemplary nail graphics laminate embodiment as a protective top coating as a supplement to graphics applied by conventional nail cosmetic techniques. The vinyl film top coat covering is laminated onto a substrate film 5000 (without printed graphics) and applied onto a nail surface 5006 containing nail graphics and/or other nail decorations 5004 applied by conventional techniques, such as, for example, nail polish, acrylic, wrap, and/or gel.

Figure 6:
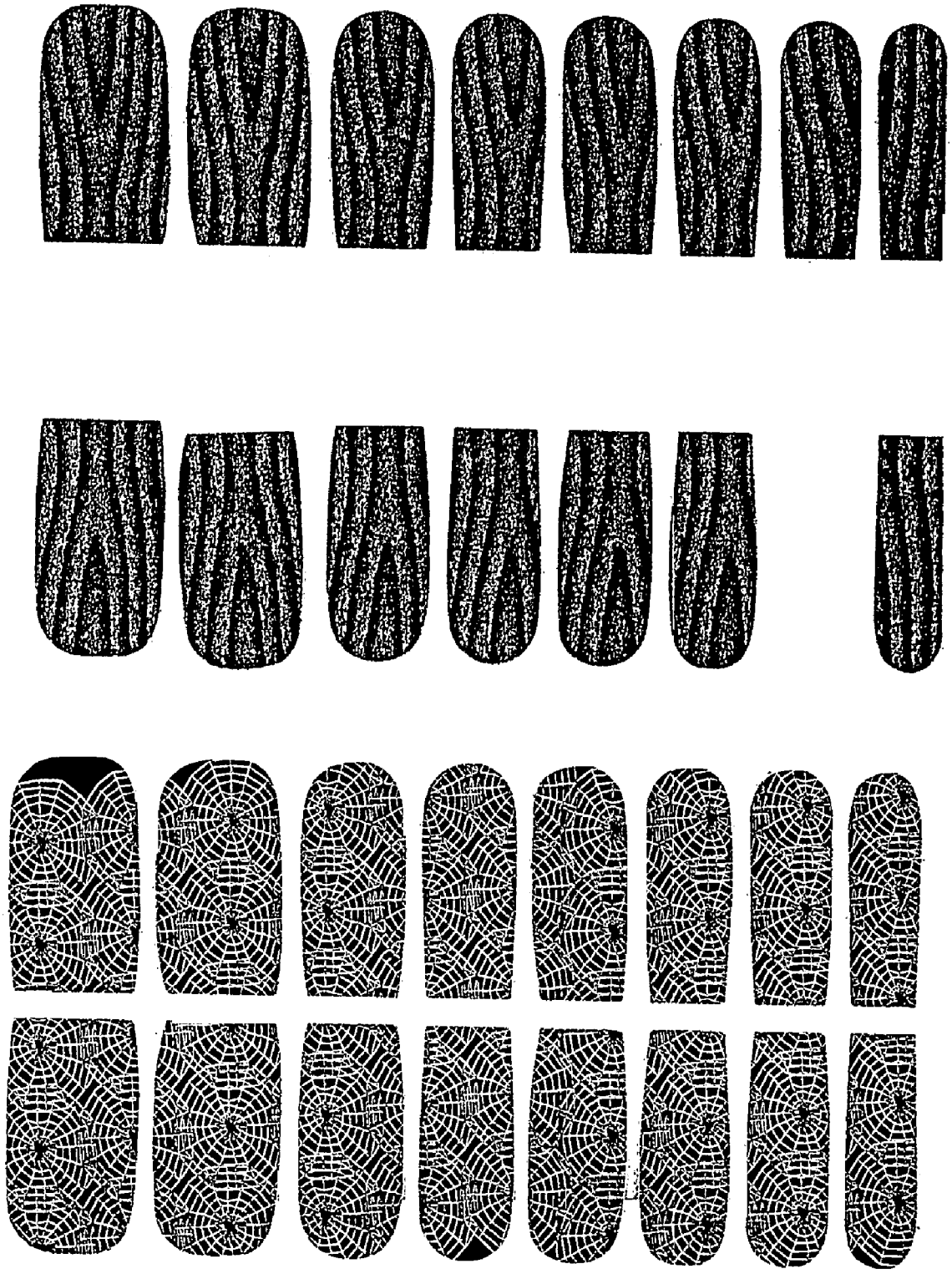
FIG. 6 illustrates an exemplary sheet of printed nail cover laminate embodiment according to the invention. Exemplary laminates illustrated herein contain sample images that may be applied to a graphic film for attachment to a fingernail or toenail.
Figure 7:
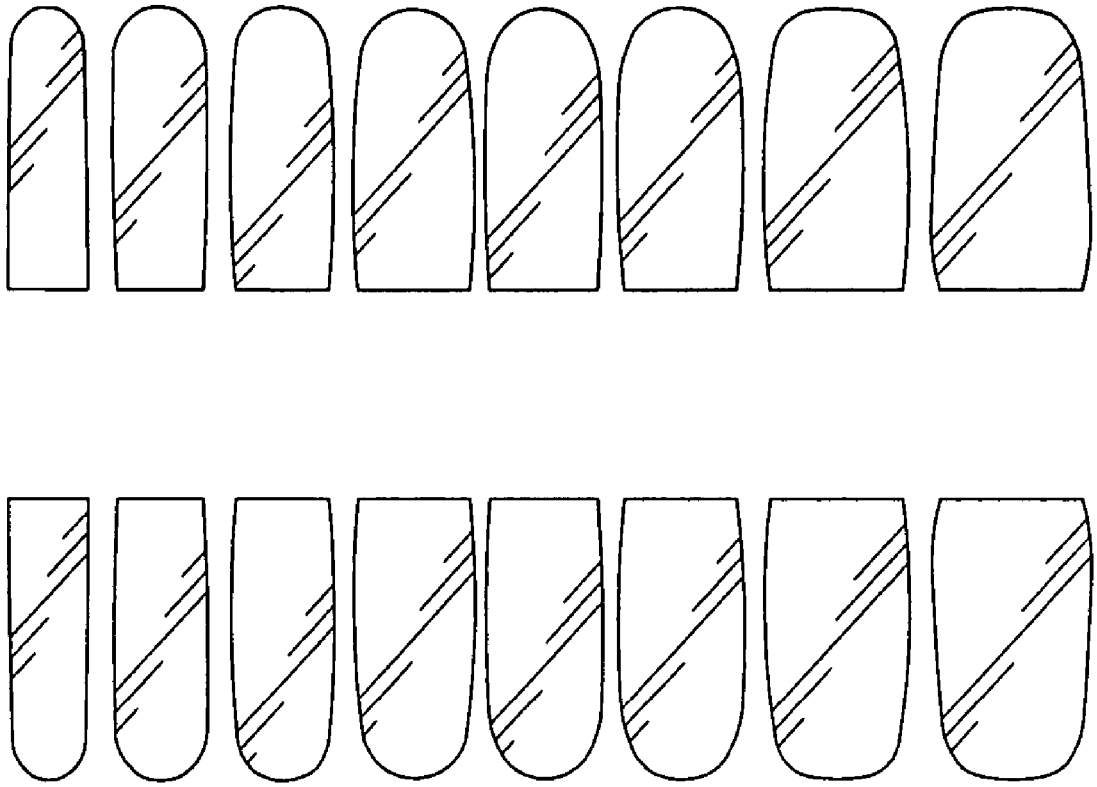
FIG. 7 illustrates an exemplary sheet of clear nail cover laminate embodiment according to the invention.

FIG. 6 and FIG. 7 illustrate sheets of graphics printed nail cover laminates according to embodiments of the present invention. A sheet may contain essentially the same design or combination of various designs and/or sizes.

In yet another aspect, a nail cover/coating kit comprising: at least one sheet comprising a plurality of graphics and/or clear nail laminates made by the methods described herein, at least one consumer packaging; and at least one instructions for use. In certain embodiments, the graphics nail laminates are stored in an air-tight pouch until they are used.

The previous description of the embodiments is provided to enable any person skilled in the art to practice the invention. The various modifications to these embodiments will be readily apparent to those skilled in the art, and the generic principles defined herein may be applied to other embodiments without the use of inventive faculty. Thus, the present invention is not intended to be limited to the embodiments shown herein, but is to be accorded the widest scope consistent with the principles and novel features disclosed herein.

What is claimed is:

1. A method of applying a nail coating laminate for nail decoration comprising:

providing a thermal-sensitive vinyl nail cover laminate wherein the vinyl nail laminate further comprises a nail graphics selected by the user to be applied to a nail surface and the laminate being releasably attached to a backing material;

cleaning the nail surface to which the nail cover laminate is to be applied, the nail surface having a curved contour;

pre-heating the nail cover laminate;

removing the heated nail cover laminate from the backing material;

applying the nail cover laminate onto the nail surface;

heat-curing the nail cover laminate disposed over the nail surface by applying heat;

conforming the nail cover laminate according to the contour of the nail surface;

shaping the nail cover laminate;

applying a second heating to cure the nail cover laminate disposed over the nail surface; and conforming the nail cover laminate according to the nail surface contour.

2. The method according to claim 1 wherein the vinyl film laminate comprises a nail graphics.

3. The method according to claim 1 wherein the vinyl film laminate is transparent.

4. The method according to claim 1 wherein the vinyl film laminate is a cast film laminate.

5. The method according to claim 1 wherein the laminate is a pressure sensitive self adhesive laminate.

6. The method according to claim 1 wherein shaping of the nail cover laminate is by filing of the laminate.

7. The method according to claim 1 wherein shaping of the nail cover laminate is by cutting of the laminate.

* * * * *